United States Patent [19]

Hütter

[11] Patent Number: 4,932,325

[45] Date of Patent: Jun. 12, 1990

[54] SAFETY DEVICE FOR AN AERODYNAMIC BODY FUSE

[75] Inventor: Horst Hütter, Tegernsee, Fed. Rep. of Germany

[73] Assignee: Messerschmitt-Bölkow-Blohm GmbH, Munich, Fed. Rep. of Germany

[21] Appl. No.: 382,731

[22] Filed: Jul. 19, 1989

[30] Foreign Application Priority Data

Aug. 26, 1988 [DE] Fed. Rep. of Germany ..... 3828949

[51] Int. Cl.[5] ..... F42C 5/00

[52] U.S. Cl. ..... 102/223; 102/229; 102/263

[58] Field of Search ..... 102/223, 229, 221, 263

[56] References Cited

U.S. PATENT DOCUMENTS

| | | | |
|---|---|---|---|
| 2,368,747 | 2/1945 | Doe et al. | 102/223 |
| 3,967,556 | 7/1976 | Post et al. | 102/223 |
| 4,188,886 | 2/1980 | Brauer et al. | 102/223 |
| 4,526,104 | 7/1985 | Brauer et al. | 102/223 |

FOREIGN PATENT DOCUMENTS

| | | | |
|---|---|---|---|
| 0162335 | 11/1985 | European Pat. Off. . | |
| 502918 | 5/1920 | France | 102/223 |
| 2344809 | 10/1977 | France | 102/263 |

*Primary Examiner*—Charles T. Jordan
*Assistant Examiner*—Stephen Johnson
*Attorney, Agent, or Firm*—Kenyon & Kenyon

[57] ABSTRACT

A safety device for use in low-speed aerodynamic bodies. The pressure conditions at the outer contour of the flying equipment are used for obtaining an arming criterion of a fuse. A slide is movable from a safe to an armed position. In the safe position, slide pickup ports are within the internal contour of the body. In the armed position, the slide pickup ports are exposed to the air stream outside the external contour of the body for creating a pressure difference for arming the fuse.

3 Claims, 3 Drawing Sheets

SAFETY DEVICE FOR AN AERODYNAMIC BODY FUSE

BACKGROUND OF THE INVENTION

The present invention relates to a safety device for an aerodynamic body fuse, in which functional parts are mounted on a slide, where the slide, upon the shift from the safe to the armed position, can be moved at least partially beyond the outside contour of the aerodynamic body.

In aerodynamic bodies flying at subsonic speed the state of the flight is to be used as the criterion for the safety release for arming the weapons carried on board. For this purpose, electric accelerometers, for one, have been proposed. On the other hand, swing-out wind wheel generators have been used in order to take an arming step by means of the electric energy generated. However, the mentioned measures exhibited decisive disadvantages with respect to operating reliability especially in view of the reversibility of the operation.

From DE-OS 35 15 898, a withdrawable slide has become known which moves parts of a fuse safety device of a flying weapon from the safe position into an armed position displaced beyond the outer surface of the weapon.

SUMMARY OF THE INVENTION

It is an object of the present invention to provide a reversibly operating safety device for an aerodynamic body which utilizes the air passing the outside of the aerodynamic body surface during flight as the arming criterion and can be actuated repeatedly with great operating reliability.

The above and other objects of the invention are achieved by a safety device for an aerodynamic body fuse, in which functional parts are mounted on a slide, where the slide, upon the shift from the safe to the armed position, can be moved at least partially beyond the outside contour of the aerodynamic body, and wherein:

the safety device comprises a piston which is arranged in a pressure space, is loaded by the force of a spring and is held in the safe position, and which is in functional connection with an arming release device;

at least on one reversibly withdrawable slide, at least one overpressure pickup and/or an underpressure pickup is arranged, the openings of which are closed in the safe position;

after the withdrawal of the slide into the armed position, the overpressure pickup acts on the one hand on the one side of the piston against the spring force and on the other hand, the underpressure pickup acts on the other side of the piston, so that the piston is moved from its safe into the armed position by means of the pressure difference between the pickups.

The particular advantage of such a safety device is the fact that by utilizing the flow and pressure conditions at the flying machine, an arming device has been provided which is of simple and rugged design and which can be actuated with operational reliability many times due to the small amount of power required for operation and because it is little prone to contamination.

BRIEF DESCRIPTION OF THE DRAWINGS

The invention will be described in greater detail in the following detailed description with reference to the drawings, in which.

DETAILED DESCRIPTION

Figure 1A:
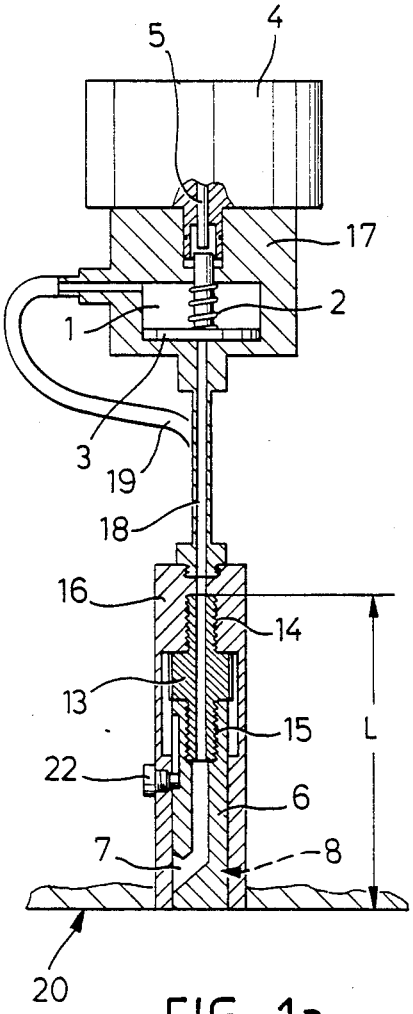
FIG. 1*a* shows a section through a safety device in the safe position.

With reference now to the drawings, the safety device shown in FIG. 1*a* is designed in two parts. In a first housing 16, there is a slide 6 which can be inserted and withdrawn and contains two pickups for overpressure 7 and underpressure 8 (not visible in FIG. 1*a*). The pickups are connected via pressure lines 18, 19 to a second housing 17 which contains a pressure chamber 1 and further parts, not shown, for applying safety and arming, respectively, to a fuse, likewise not shown.

Figure 1B:
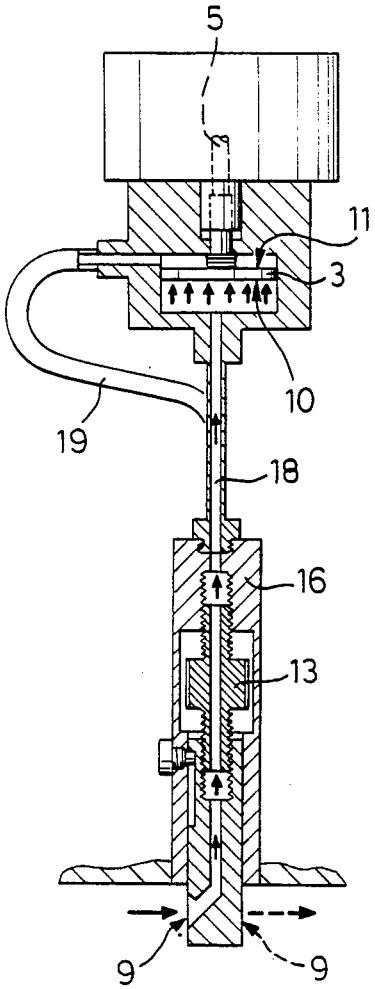
FIG. 1*b* shows a section according to FIG. 1*a* in the armed position.

In the safety position, the slide 6 is inserted completely within the outer contour 20 of the aerodynamic body. The openings 9 of the pickups are closed here, (see FIG. 1*b*) so that both pressure lines 18, 19, have the same pressure state. Thereby, a piston 3 contained in the pressure chamber 1 is loaded only by the force of the spring 2 and is held in the safety position shown in FIG. 1*a*.

Figure 1C:
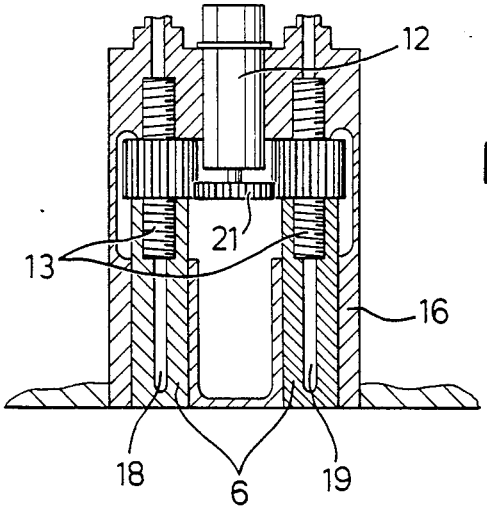
FIG. 1*c* shows a section through FIG. 1*a*.
Figure 1D:
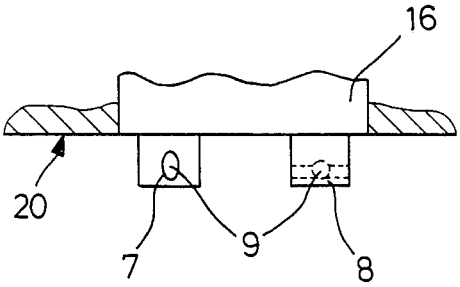
FIG. 1*d* shows a partial view of a section through FIG. 1*b*.

If now the arming process is to be initiated, then the slide 6 is withdrawn by means of an electric motor 12 visible in FIG. 1*c* which is in operational connection with shafts 13 via a gear 21. A screw 22 serves as a stop and as protection against rotation. The withdrawal process is executed until the openings 9 are exposed completely open to the air stream. The design and the arrangement of the openings 9 with respect to generating a maximum pressure difference between the overpressure pickup 7 and the underpressure pickup 8 are freely selectable within the limits of those of skill in the art.

The telescope-like withdrawal process of the slide 6 is brought about by the fact that the shaft 13 has at its ends a clockwise thread 14 and a counterclockwise thread 16, respectively. One thread is in engagement with the housing 16, and the other with the slide 6.

As soon as the slide 6 is moved into the armed position shown in FIG. lb, the piston 3 is acted upon by the pressure conditions generated by the pickups 7, 8. Via the pressure line 18, overpressure is provided to one side 10 of the piston and pushes the latter upward against the force of the spring 2. This process is aided by the underpressure present in the pressure line 19. Thus, the piston 3 is moved into its armed position and executes reversible unlatching of the arming device 4 via pin 5. The entire process can be reversed again if the electric motor 12 inserts the slide 6 completely in housing 16 again.

Figure 2:
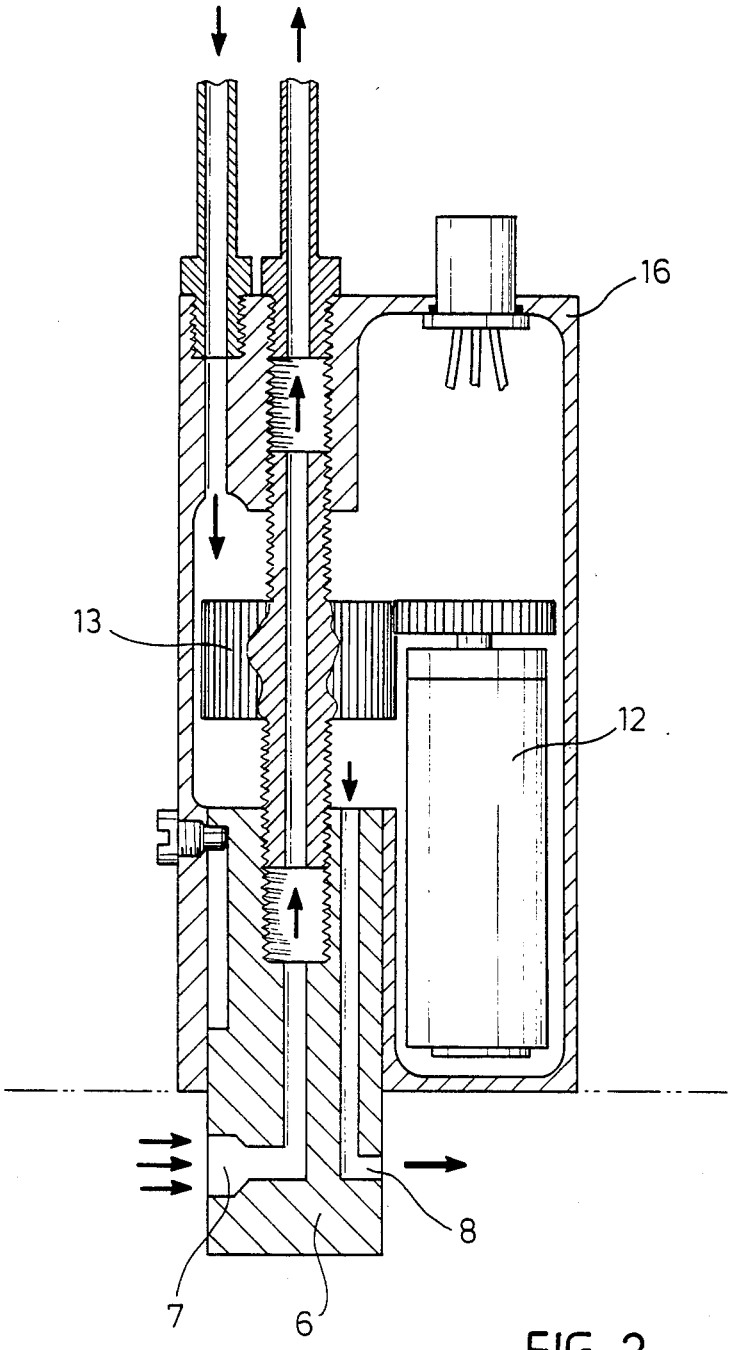
FIG. 2 shows a preferred embodiment of the safety device.

In FIG. 2, a compact embodiment of the safety device according to the invention is shown. A space-saving design is achieved by the fact that the overpressure pickup 7 as well as the underpressure pickup 8 are accommodated in the same slide 6. The operation and design, however, are the same as in the first embodiment.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A safety device for an aerodynamic body fuse, wherein functional parts are mounted on a slide, the slide being slidable in a housing of the aerodynamic body and defining a safe position wherein the slide is disposed in the housing and an armed position wherein the slide extends out of the housing, the slide being movable between said positions, and upon a shift from the safe to the armed position, the slide being moved at least partially beyond an outside contour of the aerodynamic body, and further wherein:

the safety device comprises a piston arranged in a pressure space, the piston being loaded by a spring and being held in a position corresponding to the safe position, and being in functional connection with an arming release device;

said slide having means for reversible movement and at least one of an overpressure pickup and an underpressure pickup being arranged on the slide, the pickups being coupled to openings which are closed in the safe position and disposed at least partially beyond the outside contour of the aerodynamic body in the armed position;

after movement of the slide into the armed position, the overpressure pickup acts on one side of the piston against the spring and the underpressure pickup acts on another side of the piston, so that the piston is moved from a position corresponding to the safe into a position corresponding to the armed position by means of a pressure difference between the pickups.

2. The safety device recited in claim 1, further comprising telescoping means for changing length of the slide reversibly in order to reach the armed position.

3. The safety device recited in claim 1, wherein a shaft driven by a motor is in engagement via a first thread with a housing of the safety device and via a second counter-rotating thread with the slide.

* * * * *